US009488940B2

(12) United States Patent
Maruyama et al.

(10) Patent No.: US 9,488,940 B2
(45) Date of Patent: Nov. 8, 2016

(54) FIXING DEVICE WITH TEMPERATURE SENSOR FITTED IN A RECESS OF A NIP PLATE

(71) Applicants: Yasuhiro Maruyama, Kasugai (JP); Yusuke Murodate, Nagoya (JP); Yuji Nishigaki, Hashima (JP)

(72) Inventors: Yasuhiro Maruyama, Kasugai (JP); Yusuke Murodate, Nagoya (JP); Yuji Nishigaki, Hashima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/018,734

(22) Filed: Sep. 5, 2013

(65) Prior Publication Data

US 2014/0086648 A1 Mar. 27, 2014

(30) Foreign Application Priority Data

Sep. 26, 2012 (JP) ..... 2012-211844

(51) Int. Cl.
*G03G 15/20* (2006.01)

(52) U.S. Cl.
CPC ..... *G03G 15/2039* (2013.01); *G03G 15/2053* (2013.01); *G03G 2215/2035* (2013.01)

(58) Field of Classification Search
USPC ..... 399/329
See application file for complete search history.

(56) References Cited

U.S. PATENT DOCUMENTS 8,280,286 B2 10/2012 Condello et al.
8,494,424 B2 7/2013 Ishida et al.
8,938,193 B2 * 1/2015 Suzuki ..... G03G 15/2035 399/329
2003/0170054 A1 * 9/2003 Suzuki ..... G03G 15/2064 399/328
2010/0330494 A1 12/2010 Condello et al.

(Continued)

FOREIGN PATENT DOCUMENTS

JP 2003-229234 A 8/2003
JP 2003-282230 A 10/2003

(Continued)

OTHER PUBLICATIONS

Co-Pending U.S. Appl. No. 14/018,788, filed Sep. 5, 2013.

*Primary Examiner* — Billy Lactaoen
*Assistant Examiner* — Arlene Heredia Ocasio
(74) *Attorney, Agent, or Firm* — Banner & Witcoff, Ltd.

(57) ABSTRACT

A fixing device configured to thermally fix a developing agent image to a recording sheet includes a fixing belt having a tubular shape defining an inner space, a heat generating member and a nip plate which are disposed in the inner space, and a rotating member disposed outside the inner space. The nip plate includes a plate-shaped portion holding the fixing belt against the rotating member, and a bent portion located downstream of the plate-shaped portion in a conveying direction of the recording sheet and bent to define a recess facing away from the rotating member. The bent portion protrudes farther away from the heat generating member than the plate-shaped portion. A temperature sensor for sensing a temperature of the nip plate is fitted in the recess of the bent portion so as not to be displaced in the conveying direction.

11 Claims, 5 Drawing Sheets

(56) References Cited

U.S. PATENT DOCUMENTS

| | | | | |
|---|---|---|---|---|
| 2011/0150543 | A1* | 6/2011 | Fujiwara | G03G 15/2064 399/329 |
| 2011/0164906 | A1* | 7/2011 | Ishida | G03G 15/2007 399/329 |
| 2011/0285218 | A1* | 11/2011 | Tsubakimoto | H02K 11/0047 310/50 |
| 2012/0155935 | A1* | 6/2012 | Yoshikawa | G03G 15/2053 399/329 |
| 2012/0251205 | A1* | 10/2012 | Nakao | G03G 15/2053 399/329 |
| 2012/0308277 | A1* | 12/2012 | Suzuki | G03G 15/2053 399/329 |

FOREIGN PATENT DOCUMENTS

| | | | | |
|---|---|---|---|---|
| JP | 2007-171749 | A | | 7/2007 |
| JP | 2009-229679 | A | | 10/2009 |
| JP | 2011-008253 | A | | 1/2011 |
| JP | 2011-095549 | A | | 5/2011 |
| JP | 2011-113013 | A | | 6/2011 |
| JP | 2013073171 | A | * | 4/2013 |

* cited by examiner

FIXING DEVICE WITH TEMPERATURE SENSOR FITTED IN A RECESS OF A NIP PLATE

CROSS REFERENCE TO RELATED APPLICATION

This application claims priority from Japanese Patent Application No. 2012-211844, filed on Sep. 26, 2012, the entire disclosure of which is incorporated herein by reference.

BACKGROUND OF THE INVENTION

1. Field of the Invention

The present invention relates to a fixing device configured to thermally fix a developing agent image to a recording sheet.

2. Description of Related Art

In a known fixing device configured to thermally fix a developing agent image to a recording sheet, a heat generating member, a nip plate heated by the heat generating member, a stay for supporting the nip plate, and a temperature sensor are disposed inside a tubular fixing belt. The fixing device includes the temperature sensor fixed to the stay so as to be positioned relative to the nip plate.

In such a fixing device, because the temperature sensor is supported by the stay which is a separate member from the nip plate, the positional relationship between the temperature sensor and the nip plate may change depending on the positional tolerance of the stay, and the positional precision of the temperature sensor relative to the nip plate may be adversely affected.

SUMMARY OF THE INVENTION

Therefore, a need has arisen for a fixing device in which a temperature sensor is positioned relative to a nip plate with a higher precision than before.

According to an embodiment of the invention, a fixing device configured to thermally fix a developing agent image to a recording sheet comprises a fixing belt having a tubular shape defining an inner space, a heat generating member disposed in the inner space of the fixing belt, a nip plate made of metal and disposed in the inner space of the fixing belt such that an inner surface of the fixing belt is configured to make slide contact with the nip plate, a rotating member configured to rotate and disposed outside the inner space of the fixing belt such that the fixing belt is nipped between the nip plate and the rotating member, and a temperature sensor configured to sense a temperature of the nip plate. The nip plate comprises a plate-shaped portion holding the fixing belt against the rotating member, and a bent portion located downstream of the plate-shaped portion in a conveying direction of the recording sheet and bent to define a recess facing away from the rotating member. The bent portion protrudes farther away from the heat generating member than the plate-shaped portion. The temperature sensor is fitted in the recess of the bent portion such that displacement of the temperature sensor in the conveying direction is restricted.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

DETAILED DESCRIPTION OF EMBODIMENTS

Embodiments of the invention and their features and technical advantages may be understood by referring to FIGS. 1-5B, like numerals being used for like corresponding parts in the various drawings.

In the following description, the expressions "front", "rear", "upper (up)", "lower (down)", "right", and "left" are used to define the various parts when a laser printer 1, is disposed in an orientation in which it is intended to be used.

<General Structure of Laser Printer>

Figure 1:
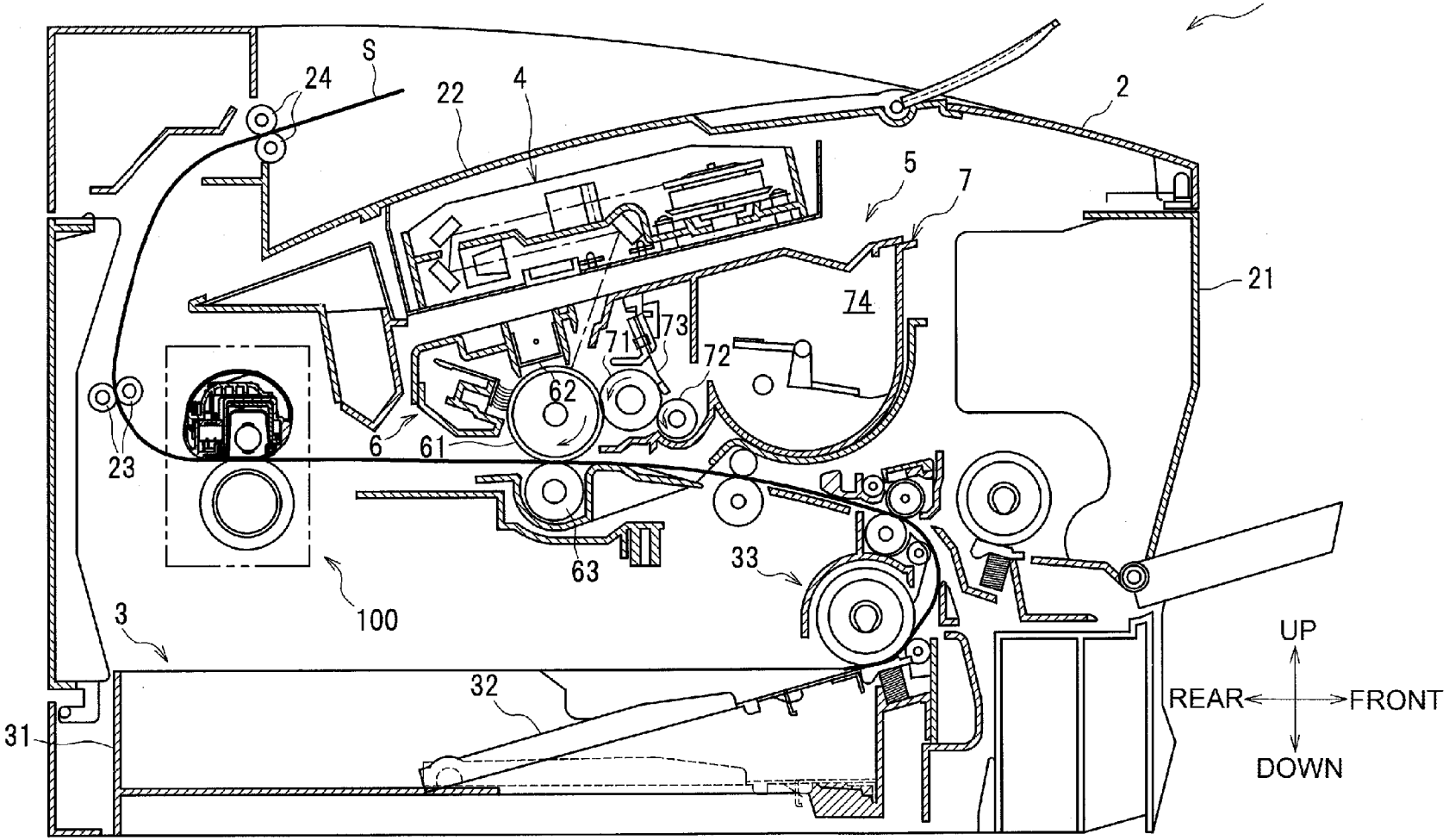
FIG. 1 is a schematic cross-sectional view showing a general structure of a laser printer including a fixing device, according to an embodiment of the invention.

As shown in FIG. 1, a laser printer 1, according to an embodiment of the invention, mainly includes, in a housing 2, a sheet feed unit 3 that feeds a recording sheet, e.g., a sheet S, an exposure device 4, a process cartridge 5 that transfers a toner image (a developing agent image) to the sheet S, and a fixing device 100 that thermally fixes the toner image on the sheet S.

The sheet feed unit 3, which is disposed at the bottom of the housing 2, mainly includes a feed tray 31, a sheet lifting plate 32, and a sheet feeding mechanism 33. A sheet S accommodated in the feed tray 31 is shifted upwardly by the sheet lifting plate 32 and is supplied toward the process cartridge 5 (specifically, a nip between a photosensitive drum 61 and a transfer roller 63) by the sheet feeding mechanism 33.

The exposure device 4, which is disposed at the upper part of the housing 2, includes a laser light emitting unit (not shown) as well as a polygon mirror, a lens, and a reflecting mirror, which are shown without reference numerals. In the exposure device 4, laser light (see the dash-dot line) emitted from the laser light emitting unit according to image data is scanned at high speed on the surface of the photosensitive drum 61 to expose the surface of the photosensitive drum 61 to light.

The process cartridge 5, which is disposed below the exposure device 4, is removably attached to the housing 2 through an opening made when a front cover 21 attached to the housing 2 is opened. The process cartridge 5 is formed with a drum unit 6 and a developing unit 7.

The drum unit 6 mainly includes the photosensitive drum 61, a charger 62, and the transfer roller 63. The developing unit 7, which is removably attached to the drum unit 6, mainly includes a developing roller 71, a supply roller 72, a blade 73, and a toner storage 74 that stores toner (a developing agent).

In the process cartridge 5, the surface of the photosensitive drum 61 is uniformly charged by the charger 62, after which laser light from the exposure device 4 is scanned at high speed on the photosensitive drum 61, so its surface is exposed to light, forming an electrostatic latent image on the photosensitive drum 61 according to the image data. Toner in the toner storage 74 is supplied through the supply roller 72 to the developing roller 71 and then enters between the developing roller 71 and the blade 73. The toner is supported on the developing roller 71 as a thin layer with a fixed thickness.

The toner supported on the developing roller 71 is supplied from the developing roller 71 to the electrostatic latent image formed on the photosensitive drum 61. Thus, the electrostatic latent image is visualized, forming a toner image on the photosensitive drum 61. When a sheet S is then conveyed between the photosensitive drum 61 and the transfer roller 63, the toner image on the photosensitive drum 61 is transferred to the sheet S.

The fixing device 100 is disposed behind the process cartridge 5. The toner image (toner) transferred to the sheet S is thermally fixed to the sheet S while the sheet S passes through the fixing device 100. The sheet S on which the toner image has been thermally fixed is discharged to a discharge tray 22 by convey rollers 23 and 24.

<Detailed Structure of Fixing Device>

Figure 2:
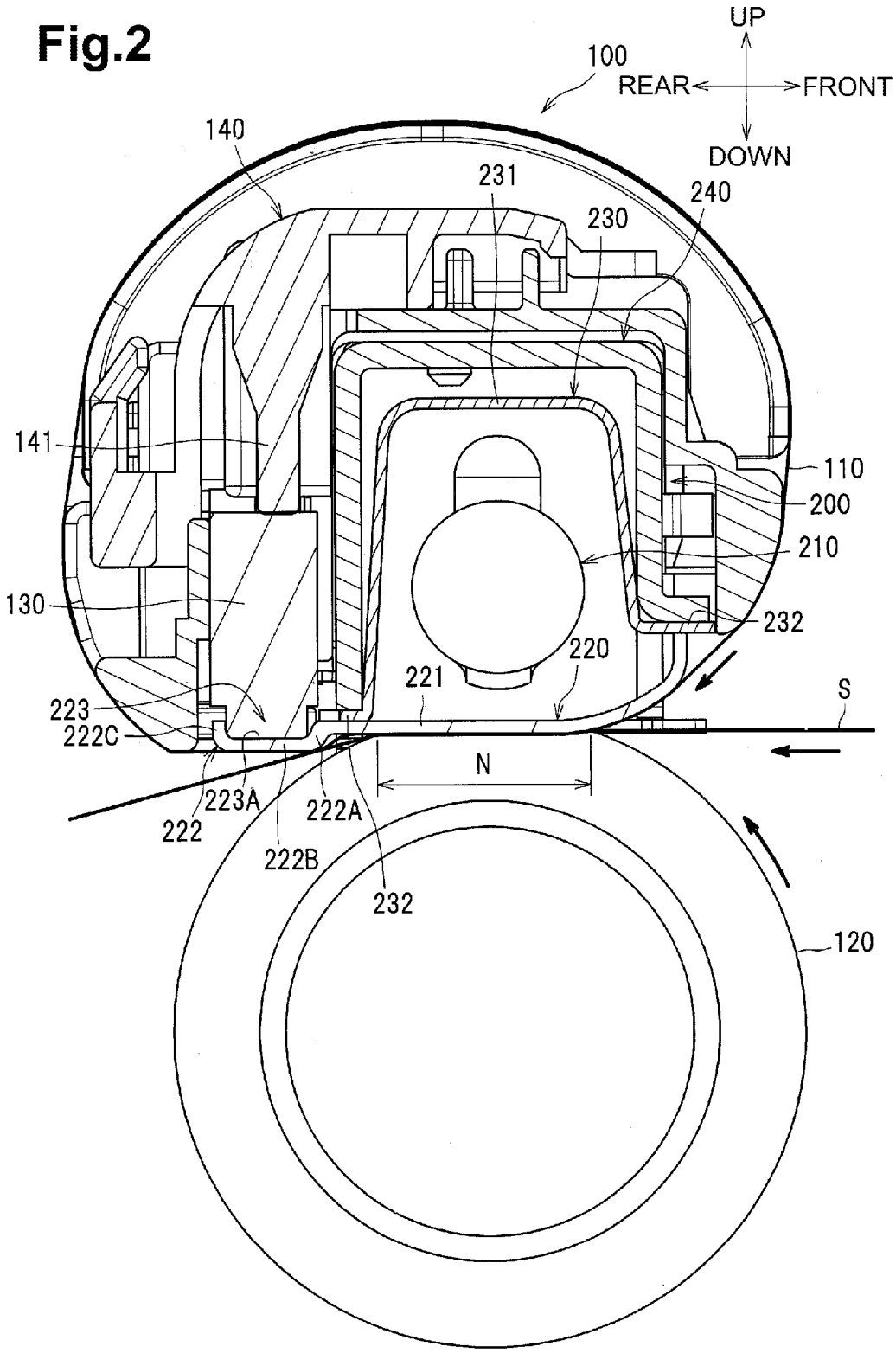
FIG. 2 is a cross-sectional view of the fixing device according to an embodiment of the invention.

As shown in FIG. 2, the fixing device 100 mainly includes a tubular fixing belt 110, a heating unit 200 that is disposed in an inner space defined by an inner peripheral surface of the fixing belt 110 and heats the fixing belt 110, and a rotating member, e.g., a pressure roller 120, temperature sensors 130, and a cover member 140. The fixing belt 110 is interposed between the pressure roller 120 and the heating unit 200.

The fixing belt 110, which is heated by the heating unit 200 described later, is a belt having heat resistance and flexibility. The rotation of the fixing belt 110 is guided by a guide member, which is shown without a reference numeral.

The pressure roller 120, which can be elastically deformed, is disposed below the fixing belt 110 and the heating unit 200 described later. When the pressure roller 120 is elastically deformed and nips the fixing belt 110 (particularly, a nip plate 220) in cooperation with the heating unit 200, a nip portion N is formed. In this embodiment, the heating unit 200 and pressure roller 120 are mutually brought into pressure contact while one of them is urged toward the other.

When a driving force is transmitted from a motor (not shown) provided in the housing 2 to the pressure roller 120, its rotation is driven. Then, the fixing belt 110 is rotated by a frictional force exerted between the pressure roller 120 and the fixing belt 110 (or the sheet S). Thus, while the sheet S, to which the toner image has been transferred, is conveyed from front to back between the pressure roller 120 and the heated fixing belt 110, the toner image (toner) is thermally fixed to the sheet S.

The heating unit 200, which heats toner on the sheet S through the fixing belt 110, includes a heat generating member, e.g., a halogen lamp 210, the nip plate 220, a reflective member 230, and a stay 240.

The halogen lamp 210 is a heater that generates radiant heat and heats the nip plate 220 and the fixing belt 110 thereby to heat the toner on the sheet S. The halogen lamp 210 is disposed in the inner space defined by the fixing belt 110 with prescribed spacings from the fixing belt 110 and from the inner face of the nip plate 220.

The nip plate 220 is a plate-shaped member made of metal and receives radiant heat from the halogen lamp 210. The nip plate 220 is disposed in the inner space defined by the fixing belt 110 so that the inner peripheral surface of the tubular fixing belt 110 makes sliding contact with the surface of the nip plate 220. In this embodiment, the nip plate 220 is formed by machining an aluminum plate, or a plate made of other material, having higher thermal conductivity than the steel stay 240 described later.

Figure 3A:
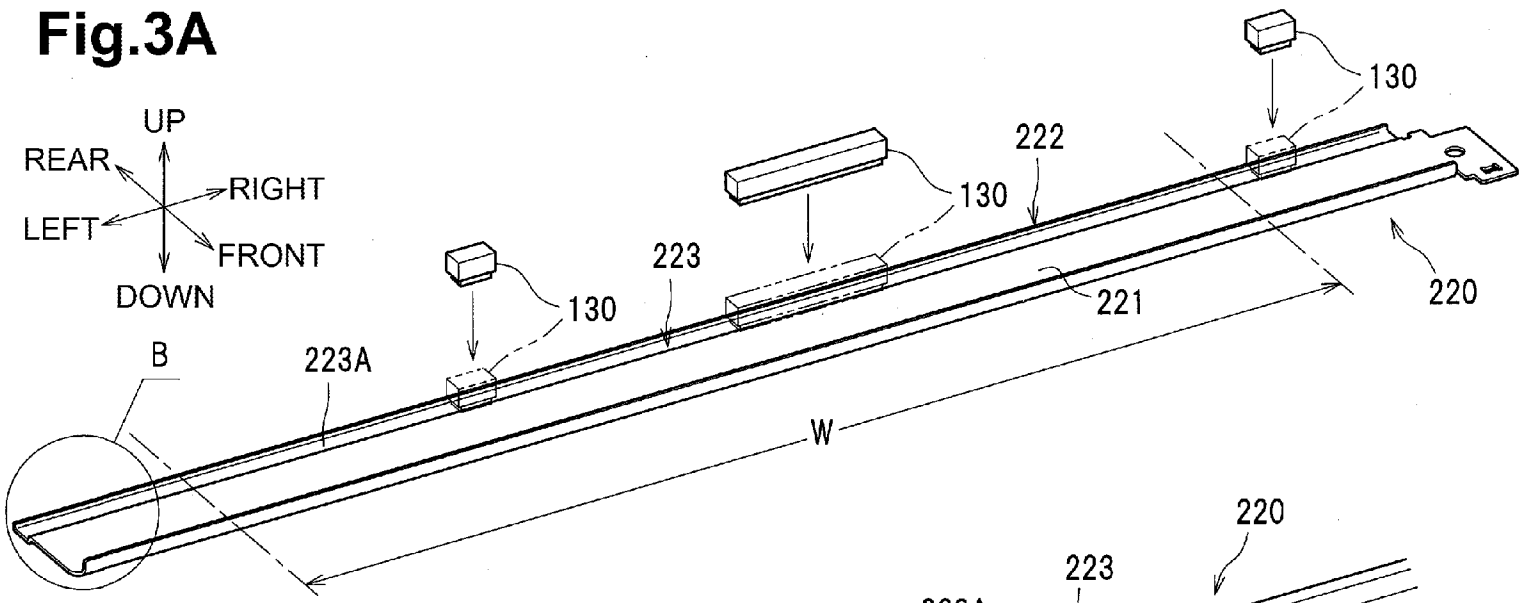
FIG. 3A is a perspective view of a nip plate and temperature sensors of the fixing device, according to an embodiment of the invention.

As shown in FIGS. 2 and 3A, the nip plate 220 includes a plate-shaped portion 221 and a bent portion 222. The plate-shaped portion 221 is formed like a plate elongated in the width direction of the sheet S (simply referred to hereinafter as the width direction), i.e., the right-left direction. The bent portion 222 is formed downstream of the plate-shaped portion 221 in the conveying direction of the sheet S (simply referred to hereinafter as the conveying direction), i.e., at the rear of the plate-shaped portion 221.

The plate-shaped portion 221, the lower face of which is in contact with the inner peripheral surface of the fixing belt 110, nips the fixing belt 110 in cooperation with the pressure roller 120. The plate-shaped portion 221 transfers heat, received from the halogen lamp 210, through the fixing belt 110 to the toner on the sheet S.

The bent portion 222 extends from the rear end of the plate-shaped portion 221 and is bent so as to form a recess 223 on an upper face of the nip plate 220, i.e., on an opposite side of the nip plate 220 from the pressure roller 120. In other words, the recess 223 faces away from the pressure roller 120. Downstream of the nip region N in the conveying direction, the bent portion 222 protrudes farther away from the halogen lamp 210 (i.e., downwardly) than the plate-shaped portion 221.

Figure 3B:
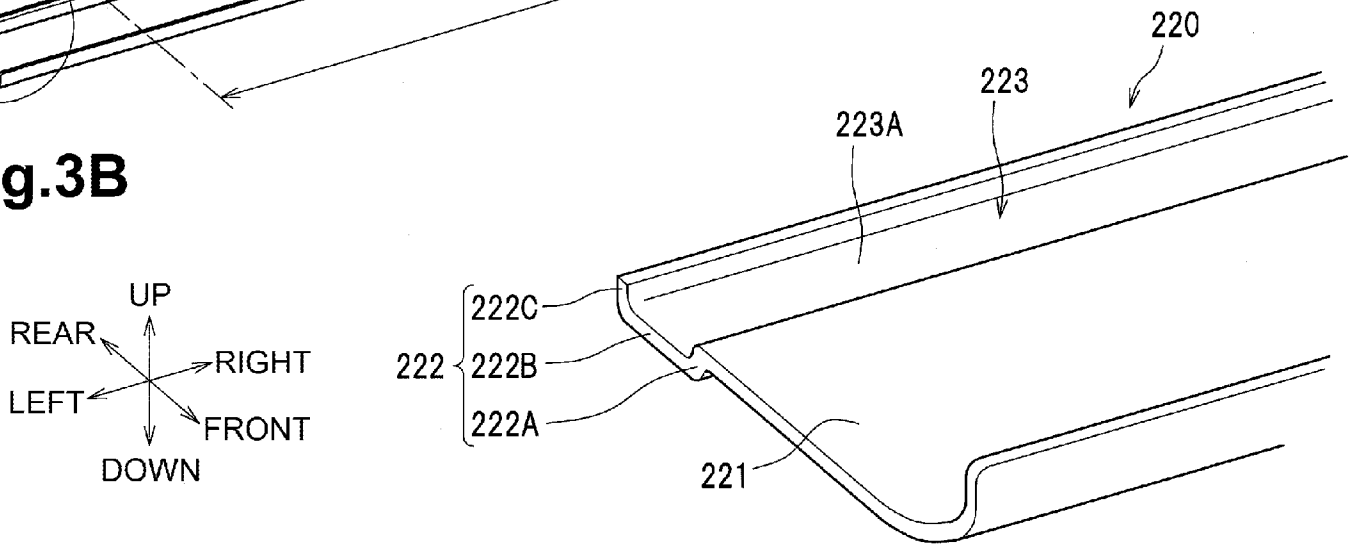
FIG. 3B is an enlarged view of a portion B of the nip plate shown in FIG. 3A.

Specifically, as shown in FIG. 3B, the bent portion 222 is bent so as to be substantially U-shaped and define an opening which is open upwardly. The bent portion 222 includes a first bent segment 222A extending downwardly from the rear end of the plate-shaped portion 221, a bottom segment 222B extending rearwardly from the lower end of the first bent segment 222A, and a second bent segment 222C extending upwardly from the rear end of the bottom segment 222B.

The bent portion 222 is formed so as to continuously extend in the width direction over the entire width of the conveying region W of the sheet S, as shown in FIG. 3A. More specifically, the bent portion 222 is also formed outside the conveying region W and extends from the left end to the right end of the plate-shaped portion 221. The end of the bent portion 222 at the upstream end of the conveying direction, i.e., the first bent segment 222A, linearly extends in the width direction and is not displaced in the conveying direction.

Since the bent portion 222 is formed as described above, the recess 223, which is groove-shaped, is formed on the upper face of the nip plate 220 such that the upper face of the bottom segment 222B becomes the bottom face 223A of the recess 223.

The bent portion 222 is formed so that the size of the recess 223 in the conveying direction is substantially the same as the size of the lower portion of the temperature sensor 130 described later. In this embodiment, the size of the bent portion 222 in the conveying direction is substantially uniform at any positions in the width direction.

The reflective member 230 reflects radiant heat (radiant heat emitted from the halogen lamp 210 mainly in the front-rear direction and in the upward direction) toward the nip plate 220 (particularly, the upper face of the plate-shaped portion 221) as shown in FIG. 2. The reflective member 230 is disposed with a prescribed spacing from the halogen lamp 210 so as to cover the halogen lamp 210.

Since this reflective member 230 collects the radiant heat from the halogen lamp 210 on the nip plate 220, the radiant heat from the halogen lamp 210 can be efficiently used, enabling the nip plate 220 and the fixing belt 110 to be quickly heated.

Specifically, the reflective member 230 is formed by bending an aluminum plate, or a plate made of other metallic material, which reflects infrared rays and far infrared rays with high reflectance, in a substantially U-shape. More specifically, the reflective member 230 has a reflective portion 231 in a curved shape, which is a substantially U-shape in cross-sectional view, and flange portions 232 that are disposed facing the nip plate 220 and extend from both ends of the reflective portion 231 in directions away from the halogen lamp 210; one of the flange portions 232 extends to the front and the other extends to the rear.

The stay 240 supports, from the opposite side from the pressure roller 120, both ends of the plate-shaped portion 221 of the nip plate 220, one end extending to the front and the other end extending to the rear, through the flange portions 232 of the reflective member 230. When a force is exerted from the pressure roller 120 to the nip plate 220, the stay 240 receives the force. The stay 240 is formed by bending a steel plate, or a metal plate, having relatively high stiffness in a substantially U-shape in cross-sectional view along the reflective member 230 (particularly, the reflective portion 231), so as to define an opening which is open toward the nip plate 220.

The temperature sensor 130, which is a known sensor such as a thermostat or a thermistor, senses the temperature of the nip plate 220 and outputs the sensing result to a control unit (not shown) that controls the fixing device 100 (particularly, the halogen lamp 210).

On the nip plate 220, two temperature sensors 130 are provided inside the conveying region W of the sheet S and one temperature sensor 130 is provided outside the conveying region W, as shown in FIG. 3A.

The lower portion of each temperature sensor 130 is fitted to the recess 223 so as to be sandwiched between the first bent segment 222A and the second bent segment 222C. Thus, the first bent segment 222A abuts the upstream side of the temperature sensor 130 in the conveying direction, and the second bent segment 222C abuts the downstream side of the temperature sensor 130 in the conveying direction, thereby restricting displacement of the temperature sensor 130 in the conveying direction. The lower face of the temperature sensor 130 is in contact with the bottom face 223A of the recess 223 (i.e., the bottom segment 222B of the bent portion 222).

The cover member 140, which is disposed in the inner space defined by the fixing belt 110, is formed so as to cover the heating unit 200, as shown in FIG. 2. The cover member 140 has contact portions 141, each of which is formed above the corresponding temperature sensor 130 so as to extend downwardly from an upper wall of the cover member 140. The lower end of the contact portion 141 abuts the upper face of the corresponding temperature sensor 130, thereby restricting upward displacement of the temperature sensor 130. This suppresses the temperature sensor 130 from coming off the recess 223.

According to the fixing device 100 structured as described above in this embodiment, the following advantages can be obtained. Since the temperature sensor 130 is fitted to the recess 223 of the nip plate 220, displacement of the temperature sensor 130 in the conveying direction is restricted, and the temperature sensor 130 is positioned relative to the nip plate 220 by the nip plate 220 itself. Thus, the temperature sensor 130 can be precisely positioned on the nip plate 220 when compared with a case in which a separate member from the nip plate 220 is used to position the temperature sensor 130 relative to the nip plate 220.

Since the nip plate 220 is a metal plate, positional change of the temperature sensor 130 due to thermal expansion can be made less likely to occur when compared with a case in which the temperature sensor 130 is supported by, for example, a resin member.

The bent portion 222 protrudes farther away from the halogen lamp 210 than the plate-shaped portion 221. This causes the fixing belt 110, after passing through the nip region N, to travel along the nip plate 220 in a direction away from the sheet S. Specifically, after passing through the nip region N, the fixing belt 110 and the sheet S travel diagonally downward along the first bent segment 222A of the bent portion 222. After passing through the first bent segment 222A, however, the fixing belt 110 travels rearward along the bottom segment 222B of the bent portion 222, and thus the fixing belt 110 travels away from the sheet S at an acute angle. Thus, the sheet S can be properly separated from the fixing belt 110.

Since the bent portion 222 is formed so as to continuously extend over the entire width of the conveying region W of the sheet S, the sheet S can be uniformly separated from the fixing belt 110 when compared with a case in which the bent portion 222 is partially formed.

The second bent segment 222C of the bent portion 222 extends farther upward than the bottom segment 222B. Thus, even if a lubricant such as grease is supplied between the fixing belt 110 and the nip plate 220, the second bent segment 222C blocks the lubricant, making the lubricant less likely to enter the recess 223 in which the temperature sensor 130 is placed.

So far, an embodiment of the invention has been described, but the invention is not limited to the embodiment. The specific structures can be appropriately changed without departing from the intended scope of the invention. In the description below, the same elements as in the embodiment described above are denoted by the same reference numerals and repeated descriptions will be omitted.

Although, in the embodiment described above, the bent portion 222 has been formed so that its size in the conveying direction is substantially uniform at any positions in the width direction, the invention is not limited to this structure. For example, the bent portion 222 may have different sizes in the conveying direction at the portion at which the temperature sensor 130 is disposed and at any other portions.

Figure 4A:
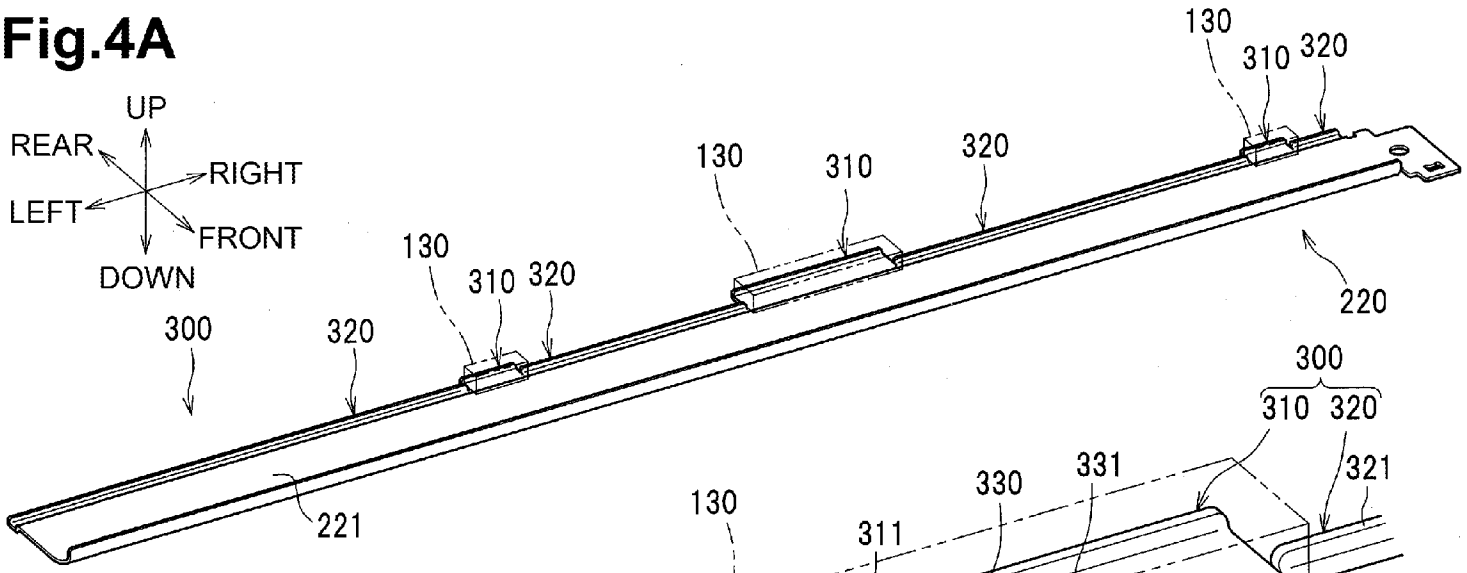
FIG. 4A is a perspective view of a nip plate and temperature sensors of a fixing device, according to another embodiment of the invention.

In a specific example in FIG. 4A, a bent portion 300 includes sensed portions 310 (second portions) at which the temperature sensors 130 are disposed respectively, and side portions 320 (first portions), two of which extend in the width direction respectively from opposite ends of a corresponding one of the sensed portions 310. The side portions 320 are smaller in size in the conveying direction than the sensed portions 310. The sensed portions 310 and the side portions 320 extend from the rear end of the plate-shaped portion 221 and are bent in a substantially U-shape as in the embodiment described above. Each sensed portion 310 has a recess 330 formed on the upper face of the nip plate 220.

Figure 4B:
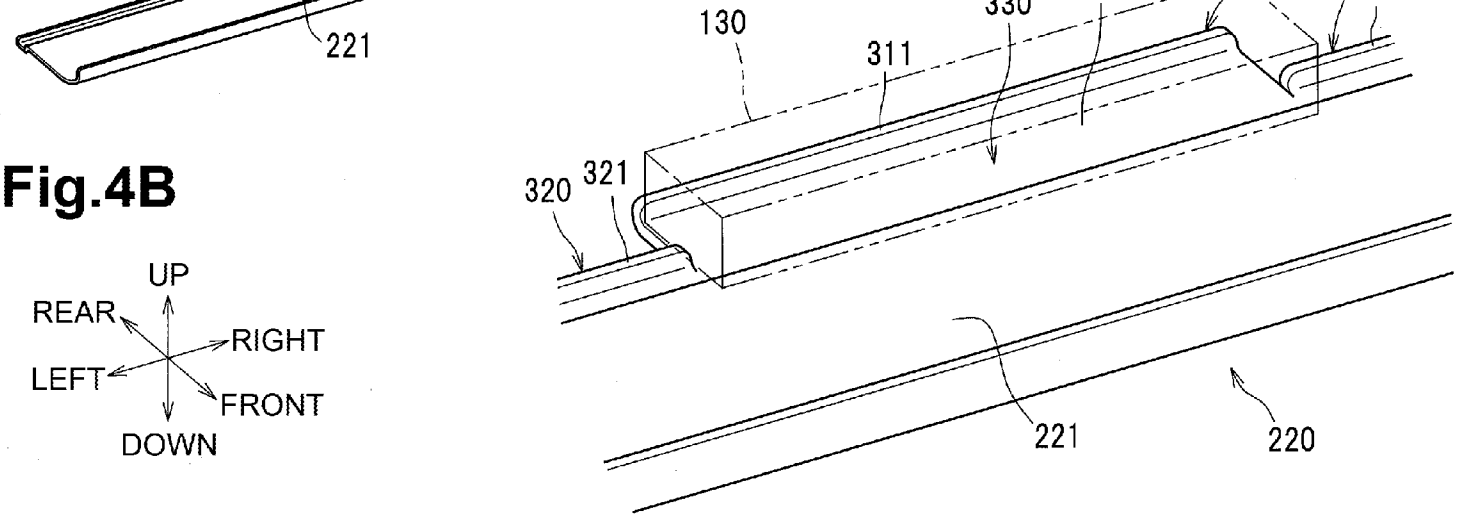
FIG. 4B is an enlarged view of a sensed portion of the nip plate shown in FIG. 4A.

As shown in FIG. 4B, the front end of the sensed portion 310 is at the same position in the conveying direction as the front end of the side portion 320, but the rear end of the sensed portion 310 protrudes farther downstream in the conveying direction than the rear end of the side portion 320. The sizes of the sensed portion 310 in the conveying direction and in the width direction are enough for the temperature sensor 130 to be fitted to the recess 330 formed in the sensed portion 310.

The three temperature sensors 130 are formed in different sizes and shapes as shown in FIG. 4A. Each sensed portion 310 is formed with a shape and size that match the corresponding temperature sensor 130 to be disposed in the sensed portion 310. Thus, each temperature sensor 130 can be placed at the exact position when the fixing device 100 is assembled.

As shown in FIG. 4B, since the sensed portion 310 protrudes farther downstream in the conveying direction than the side portion 320, a second bent segment 321, which is the downstream end of the side portion 320 in the conveying direction, is disposed upstream of a second bent segment 311, which is the downstream end of the sensed portion 310 in the conveying direction. The second bent segment 321 protrudes upwardly above the bottom face 331 of the recess 330 formed in the sensed portion 310 (protrudes in a direction away from the pressure roller 120).

Since the bent portion 300 is formed as described above and the temperature sensor 130 is fitted to the recess 330 formed in the sensed portion 310, displacement of the temperature sensor 130 in the conveying direction is restricted as in the embodiment described above. In addition, since the temperature sensor 130 is sandwiched between the second bent segments 321 of the side portions 320 formed on both sides of the sensed portion 310 in the width direction, displacement of the temperature sensor 130 in the width direction is also restricted. Thus, the nip plate 220 not only positions the temperature sensor 130 in the conveying direction but also positions it in the width direction. This further improves the positional precision of the temperature sensor 130 relative to the nip plate 220.

Figures 5A, 5B:
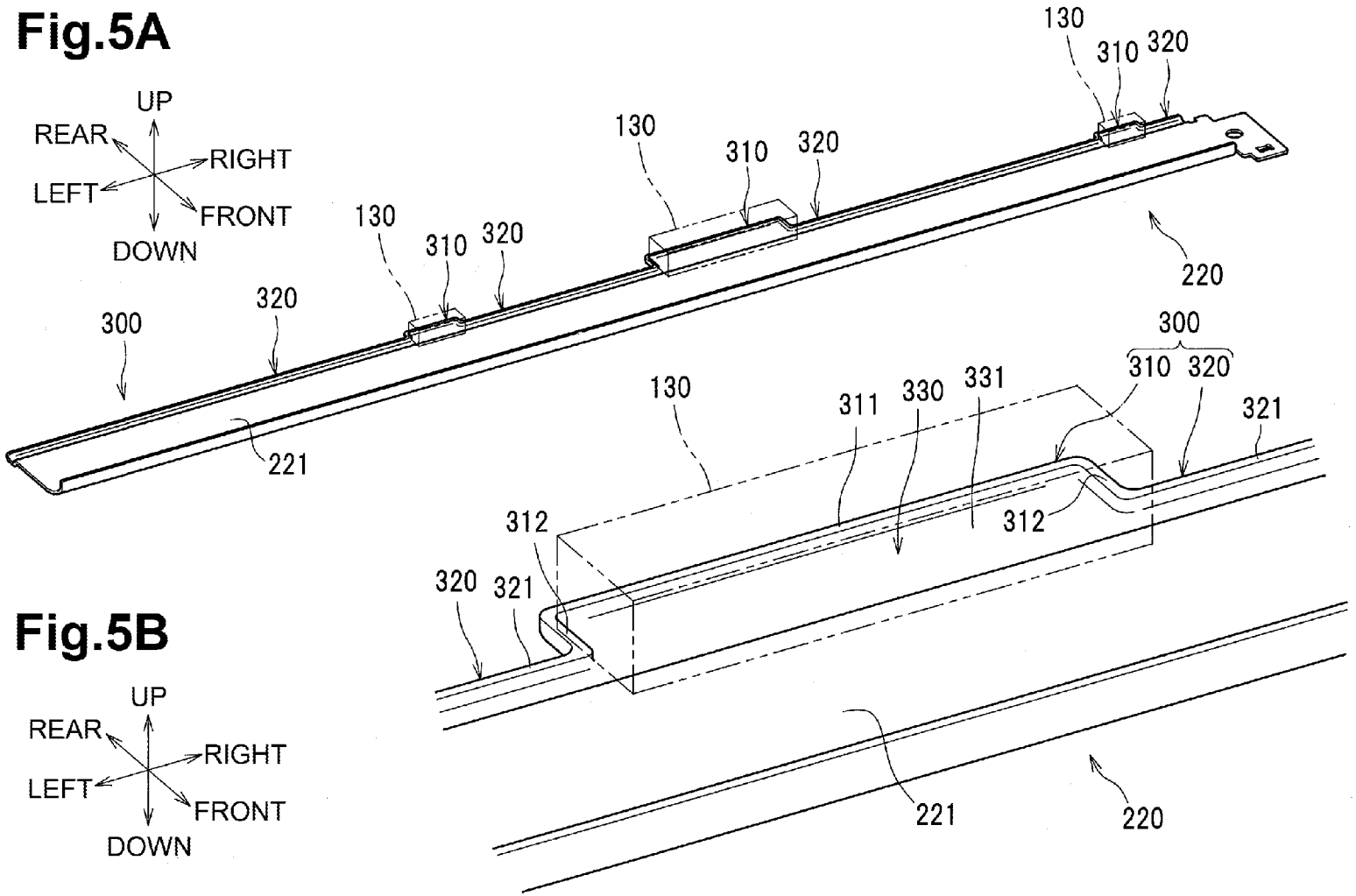
FIG. 5A is a perspective view of a nip plate and temperature sensors of a fixing device, according to another embodiment of the invention.
FIG. 5B is an enlarged view of a sensed portion of the nip plate shown in FIG. 5A.

Furthermore, as shown in FIGS. 5A and 5B, the sensed portion 310 may include stopper walls 312 formed so as to protrude upwardly from both ends, in the width direction, of the sensed portion 310.

Each stopper wall 312 is formed at one of both ends, in the width direction, of the sensed portion 330 so as to protrude upwardly from the bottom face 331 of the recess 330. Each stopper wall 312 extends downstream from the side portion 320 so as to connect the second bent segment 321 of the side portion 320 to the second bent segment 311 of the sensed portion 310.

The stopper walls 312 formed in this way can block a lubricant supplied between the fixing belt 110 and the nip plate 220, thereby to make the lubricant less likely to enter the interior of the sensed portion 310 which extends from the side portions 320.

Since the stopper walls 312 sandwich the temperature sensor 130 in the width direction, displacement of the temperature sensor 130 can be restricted in the width direction as well. Accordingly, the positional precision of the temperature sensor 130 is further improved.

Although, in the embodiment described above, the bent portion 222 is bent in a substantially U-shape so as to define an opening which is open upwardly, the invention is not limited to this shape. The bent portion may have any other shape as long as the bent portion abuts the temperature sensor 130 at least from the upstream and downstream sides in the conveying direction to restrict displacement of the temperature sensor 130 in the conveying direction.

Although, in the embodiment described above, the halogen lamp 210 is taken as an example of a heat generating member, the invention is not limited to this. The heat generating member may be, for example, a carbon heater.

Although, in the embodiment described above, the pressure roller 120 is taken as an example of a rotating member, the invention is not limited to this. The rotating member may be, for example, a belt-shaped pressurizing member.

Although, in the embodiment described above, the sheet S such as plain paper and a postcard is taken as an example of the recording sheet, the invention is not limited to this. The recording sheet may be, for example, an overhead projector (OHP) sheet.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. A fixing device configured to thermally fix a developing agent image to a recording sheet, the fixing device comprising:

a fixing belt having a tubular shape defining an inner space;

a heat generating member disposed in the inner space of the fixing belt;

a nip plate made of metal and disposed in the inner space of the fixing belt such that an inner surface of the fixing belt is configured to make slide contact with a first side of the nip plate;

a rotating member disposed outside the inner space of the fixing belt such that the fixing belt is nipped at a nip region between the first side of the nip plate and the rotating member, the rotating member having a downstream peripheral portion located downstream of the nip region in a conveying direction of the recording sheet;

a stay configured to support a second side of the nip plate which is opposite to the first side and receive a force exerted by the rotating member on the nip plate, the stay including a first stay portion extending over the heat generating member in parallel with the conveying direction, and a second stay portion extending from the first stay portion toward the rotating member;

a temperature sensor configured to sense a temperature of the nip plate; and a cover member disposed inside of the fixing belt and outside of the stay and covering the first stay portion and the second stay portion, wherein the nip plate includes:

a plate-shaped portion holding the fixing belt against the rotating member; and a bent portion located downstream of the plate-shaped portion in the conveying direction, bent to define a recess on the second side of the nip plate, and protruding toward the downstream peripheral portion of the rotating member relative to the plate-shaped portion, the bent portion including an upstream bent segment and a downstream bent segment located respectively at an upstream end and a downstream end of the bent portion in the conveying direction, and a bottom segment located between the upstream bent segment and the downstream bent segment, the upstream end of the upstream bent segment being located downstream of a downstream end of the second stay portion in the conveying direction, wherein the upstream bent segment extends, in a width direction perpendicular to the conveying direction, continuously over an entire width of a conveying region of the recording sheet, wherein, on the second side of the nip plate, the bottom segment supports a bottom surface of the temperature sensor, and the upstream bent segment and the downstream bent segment sandwich the temperature sensor in the conveying direction, to thereby restrict displacement of the temperature sensor in the conveying direction, wherein the cover member includes:

a wall portion extending parallel with the conveying direction and disposed over the first stay portion; and a contact portion extending from the wall portion toward the rotating member and in contact with a contact area of a top surface of the temperature sensor, the top surface being opposite to the bottom surface of the temperature sensor, and the contact area being downstream of the upstream bent segment and upstream of the downstream bent segment in the conveying direction, and wherein, on the first side of the nip plate, the upstream bent segment is configured to guide the recording sheet away from the fixing belt toward the downstream peripheral portion of the rotating member while the fixing belt travels along the upstream bent segment and the bottom segment.

2. The fixing device according to claim 1, further comprising another temperature sensor which is fitted in the recess of the bent portion of the nip plate, at a position shifted from the temperature sensor in the width direction.

3. The fixing device according to claim 1, wherein the upstream bent segment extends downwardly from a downstream end of the plate-shaped portion with respect to the conveying direction, the bottom segment extends in the conveying direction from a lower end of the upstream bent segment, and the downstream bent segment extends upwardly from a downstream end of the bottom segment.

4. The fixing device according to claim 1, further comprising a reflective member for reflecting radiant heat emitted by the heat generating member, wherein the reflective member covers the heat generating member, wherein the nip region is located within the reflective member in the conveying direction, and wherein the bent portion of the nip plate is located outside of the reflective member in the conveying direction.

5. The fixing device according to claim 1, wherein the nip region is located within the stay in the conveying direction.

6. The fixing device according to claim 1, further comprising a reflective member covering the heat generating member and configured to reflect radiant heat emitted by the heat generating member, wherein the cover member covers the stay which covers the reflective member.

7. The fixing device according to claim 1, wherein the recess defined by the bent portion is elongated in the width direction and has a uniform dimension in the conveying direction.

8. A fixing device configured to thermally fix a developing agent image to a recording sheet, the fixing device comprising:

a fixing belt having a tubular shape defining an inner space;

a heat generating member disposed in the inner space of the fixing belt;

a nip plate made of metal and disposed in the inner space of the fixing belt such that an inner surface of the fixing belt is configured to make slide contact with a first side of the nip plate;

a rotating member disposed outside the inner space of the fixing belt such that the fixing belt is nipped at a nip region between the first side of the nip plate and the rotating member, the rotating member having a downstream peripheral portion located downstream of the nip region in a conveying direction of the recording sheet;

a stay configured to support a second side of the nip plate which is opposite to the first side and receive a force exerted by the rotating member on the nip plate; and a temperature sensor configured to sense a temperature of the nip plate, wherein the nip plate includes:

a plate-shaped portion holding the fixing belt against the rotating member;

a first bent portion located downstream of the plate-shaped portion in the conveying direction, bent to define on the second side of the nip plate a first recess in which the temperature sensor is fitted, and protruding toward the downstream peripheral portion of the rotating member relative to the plate-shaped portion, the first bent portion including a part of an upstream bent segment, a first bottom segment, and a first downstream bent segment arranged in this order in the conveying direction, an upstream end of the upstream bent segment being located downstream of a downstream end of the stay in the conveying direction; and a pair of second bent portions each located downstream of the plate-shaped portion in the conveying direction, bent to define on the second side of the nip plate a second recess which has a smaller dimension in the conveying direction than the temperature sensor, and protruding toward the downstream peripheral portion of the rotating member relative to the plate-shaped portion, each of the second bent portions including a part of the upstream bent segment, a second bottom segment, and a second downstream bent segment arranged in this order in the conveying direction, wherein the upstream bent segment extends, in a width direction perpendicular to the conveying direction, continuously over an entire width of a conveying region of the recording sheet, wherein, on the second side of the nip plate, the first bottom segment of the first bent portion supports a bottom surface of the temperature sensor, and the upstream bent segment and the first downstream bent segment sandwich the temperature sensor in the conveying direction while the second downstream bent segments of the second bent portions sandwich the temperature sensor therebetween in the width direction, to thereby restrict displacement of the temperature sensor in the conveying direction and in the width direction, and wherein, on the first side of the nip plate, the upstream bent segment is configured to guide the recording sheet away from the fixing belt toward the downstream peripheral portion of the rotating member while the fixing belt travels along the upstream bent segment and the first and the second bottom segments.

9. The fixing device according to claim 8, wherein the nip plate further includes a pair of stopper walls each raised from the first bottom segment in a direction away from the downstream peripheral portion of the rotating member and extending in the conveying direction between the first downstream bent segment and a corresponding one of the second downstream bent segments, the stopper wall being configured to reduce flow of a lubricant, when supplied between the nip plate and the fixing belt, into the first bottom segment.

10. The fixing device according to claim 8, further comprising another temperature sensor, wherein the second bottom segment of one of the second bent portions supports a bottom surface of the another temperature sensor.

11. A fixing device configured to thermally fix a developing agent image to a recording sheet, the fixing device comprising:

a fixing belt having a tubular shape defining an inner space;

a heat generating member disposed in the inner space of the fixing belt;

a nip plate made of metal and disposed in the inner space of the fixing belt such that an inner surface of the fixing belt is configured to make slide contact with a first side of the nip plate;

a rotating member disposed outside the inner space of the fixing belt such that the fixing belt is nipped at a nip region between the first side of the nip plate and the rotating member, the rotating member having a downstream peripheral portion located downstream of the nip region in a conveying direction of the recording sheet;

a stay configured to support a second side of the nip plate which is opposite to the first side and receive a force exerted by the rotating member on the nip plate, the stay including a first stay portion extending over the heat generating member in parallel with the conveying direction, and a second stay portion extending from the first stay portion toward the rotating member;

a temperature sensor configured to sense a temperature of the nip plate; and a cover member disposed inside of the fixing belt and outside of the stay and covering the first stay portion and the second stay portion, wherein the nip plate includes:

a plate-shaped portion holding the fixing belt against the rotating member;

a first bent portion located downstream of the plate-shaped portion in the conveying direction, bent to define on the second side of the nip plate a first recess in which the temperature sensor is fitted, and protruding toward the downstream peripheral portion of the rotating member relative to the plate-shaped portion, the first bent portion including a part of an upstream bent segment, a first bottom segment, and a first downstream bent segment arranged in this order in the conveying direction, an upstream end of the upstream bent segment being located downstream of a downstream end of the stay in the conveying direction;

a pair of second bent portions each located downstream of the plate-shaped portion in the conveying direction, bent to define on the second side of the nip plate a second recess which is smaller in dimension in the conveying direction than the temperature sensor, and protruding toward the downstream peripheral portion of the rotating member relative to the plate-shaped portion, each of the second bent portions including a part of the upstream bent segment, a second bottom segment, and a second downstream bent segment arranged in this order in the conveying direction; and a pair of stopper walls each raised from the first bottom segment in a direction away from the downstream peripheral portion of the rotating member and extending in the conveying direction between the first downstream bent segment and a corresponding one of the second downstream bent segments, wherein the upstream bent segment extends, in a width direction perpendicular to the conveying direction, continuously over an entire width of a conveying region of the recording sheet, wherein, on the second side of the nip plate, the first bottom segment of the first bent portion supports a bottom surface of the temperature sensor, and the upstream bent segment and the first downstream bent segment sandwich the temperature sensor in the conveying direction while the second downstream bent segments of the second bent portions sandwich the temperature sensor therebetween in the width direction, to thereby restrict displacement of the temperature sensor in the conveying direction and in the width direction, wherein the cover member includes:

a wall portion extending parallel with the conveying direction and disposed over the first stay portion; and a contact portion extending from the wall portion toward the rotating member and in contact with a contact area of a top surface of the temperature sensor, the top surface being opposite to the bottom surface of the temperature sensor, and the contact area being downstream of the upstream bent segment and upstream of the downstream bent segment in the conveying direction, wherein, on the first side of the nip plate, the upstream bent segment is configured to guide the recording sheet away from the fixing belt toward the downstream peripheral portion of the rotating member while the fixing belt travels along the upstream bent segment and the first and the second bottom segments, and wherein the stopper walls are configured to reduce flow of a lubricant, when supplied between the nip plate and the fixing belt, into the first bottom segment.

* * * * *